US006126108A

United States Patent [19]

Bush

[11] Patent Number: 6,126,108

[45] Date of Patent: Oct. 3, 2000

[54] MATERIAL DISPENSER

[76] Inventor: Earnest Lee Bush, 6602 Beldart, Houston, Tex. 77087

[21] Appl. No.: 09/276,628

[22] Filed: Mar. 25, 1999

[51] Int. Cl.[7] ..... B65H 16/04; B65H 23/08

[52] U.S. Cl. ..... 242/588.2; 242/423.2

[58] Field of Search ..... 242/423.2, 405.3, 242/588.2, 588.1, 591, 592

[56] References Cited

U.S. PATENT DOCUMENTS

| | | | |
|---|---|---|---|
| 3,379,386 | 4/1968 | Bobolts et al. . | |
| 4,067,510 | 1/1978 | McGonagle | 242/588.2 |
| 4,102,513 | 7/1978 | Guard . | |
| 4,714,211 | 12/1987 | Hwang . | |
| 4,989,803 | 2/1991 | Lambert et al. | 242/588.2 |
| 5,794,883 | 8/1998 | MacEwen | 242/423.2 |
| 5,871,170 | 8/1998 | Morales et al. | 242/599.1 |

OTHER PUBLICATIONS

Unnamed Catalogue listing–p. 1923 Listing "Stretch Film Handwrappers" etc.

*Primary Examiner*—John M. Jillions
*Attorney, Agent, or Firm*—The Matthews Firm

[57] ABSTRACT

The present invention provides an improved material dispenser which allows adjusting of the handle portion of the dispenser relative to the material being dispensed, allowing a user to achieve a more-or-less constant planar relationship between the material and the object being wrapped. Further, the present invention provides a means of securing the loose end of the material to the handle of the dispenser.

20 Claims, 5 Drawing Sheets

MATERIAL DISPENSER

TECHNICAL FIELD

In general, the present invention relates to an improved hand-held apparatus for dispensing material. In particular, the present invention relates to an improved hand-held apparatus for dispensing plastic or similar material spooled about an object.

BACKGROUND ART

In the prior art, rolls of plastic film and other spooled material, whether or not under tension, are placed on hand-held dispensers for relatively unlimited dispersal about various types of objects. Most prior art hand-held dispensers have a single hand drip but some of the prior art dispensers have two hand grips. Use of the prior art dispensers is awkward, uncomfortable, and tiring when attempting to use these dispensers to unwrap film about objects that are either near the ground or above the shoulders of the person doing the unwrapping of the material. Further, unwrapping material in positions near the ground or above the shoulders of the person doing the unwrapping can lead to uneven wrapping because the offset of the wrap relative to the object being wrapped varies. Prior art dispensers also lack a convenient means to secure the free end of the dispensable material, leading to a waste of dispensable material as well as a waste of time when attempting to locate the free end on the roll.

It is therefore an object of the present invention to provide an improved material dispenser. Accordingly, an improved hand-held apparatus for dispensing dispensable material is described.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

GENERAL DESCRIPTION AND EXEMPLARY MODE FOR CARRYING OUT THE INVENTION

The present invention comprises an improved hand-held apparatus for dispensing materials, including spooled wrapping materials such as plastic or similar film.

Figure 1:
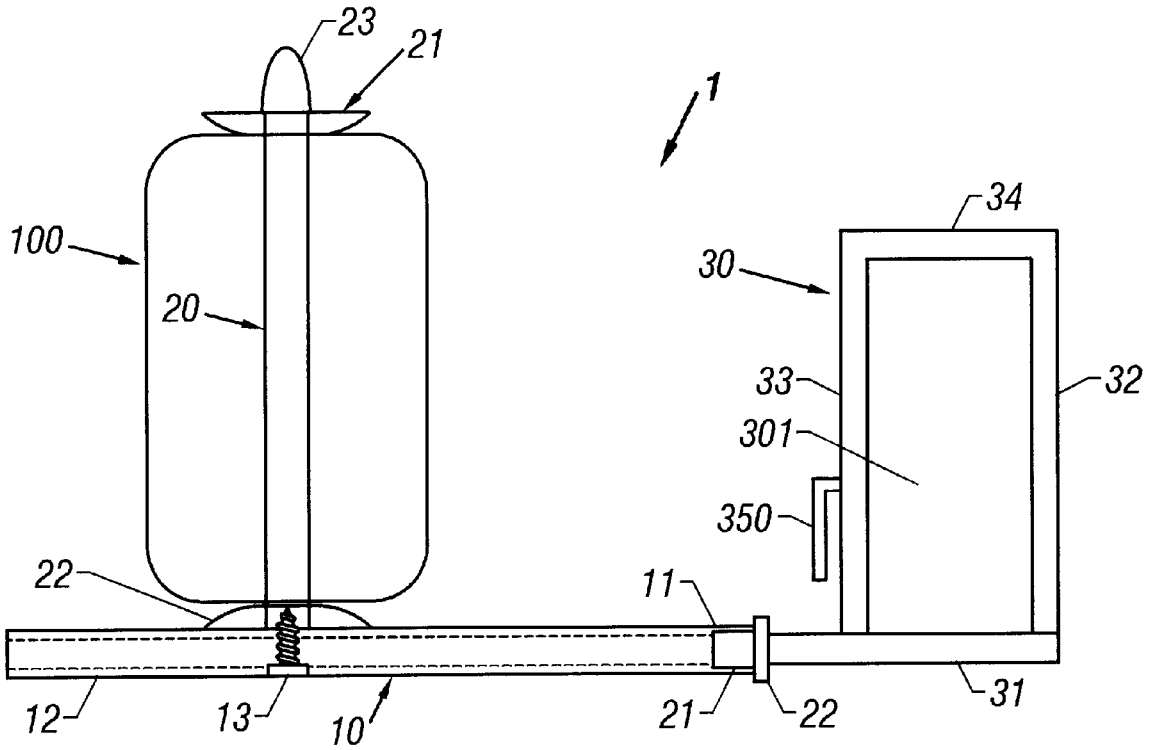
FIG. 1 is a side view of the present invention.

Referring now to FIG. 1, a side view of the present invention, the improved material dispenser of the present invention, generally referred to by the numeral 1, comprises a base 10, a spindle 20 extending substantially perpendicularly from base 10, a handle 30, and a dispensable material 100.

Figure 2:
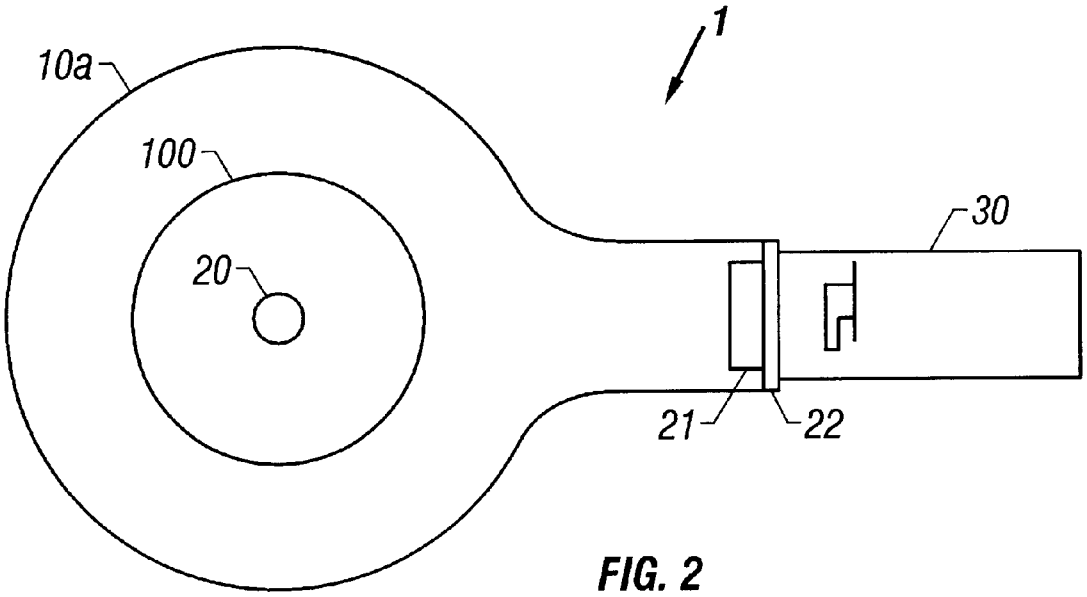
FIG. 2 is a top view of a paddle shaped base.

Base 10 is constructed out of wood, metal, or other suitable materials. Base 10 is substantially rectangular but may be any shape including tubular, oblong, symmetrical, non-symmetrical, cylindrical, flat, or rounded, provided that spindle 20 and handle grip 30 can be connected to base 10 in a manner consistent with the teaching of the present invention. As shown in FIG. 2, a top view of the present invention with a paddle shaped base 10, in an alternate embodiment, base 10*a* may be paddle shaped to allow a more stable base when setting improved material dispenser 1 down on a surface.

Referring back to FIG. 1, however shaped, base 10 has a base coupler 11 integral with or attached to one end of base 10 for attaching handle 30 to base 10.

Spindle 20 is sized to receive dispensable material 100. Spindle 20 may be cylindrical, although any shape is acceptable provided that spindle 20 can receive dispensable material 100 in such a manner as to be able to dispe nse dispensable material 100. In the preferred embodiment, spindle 20 is fixedly attached to spindle end 12 of base 10. Spindle 20 may also be attached by welding spindle 20 onto base 10 or by producing spindle 20 as part of base 10 by a molding or casting process or the like. In alternative embodiments, spindle 20 may be rotatably or removably attached to spindle end 12 of base 10. In one alternative embodiment, spindle 20 may be removably attached to base 10, for example by securing spindle 20 onto base 10 by a set screw 13, as shown in FIG. 1. In certain cases, spindle 20 may be non-cylindrical and required to rotate as dispensable material 100 is dispensed.

A spindle cap 23 is removably attached onto the end of spindle 20 that is not attached to base 10. The outer perimeter of spindle cap 23 is larger than the inner diameter of dispensable material 100, thereby allowing insertion of spindle 20 in through dispensable material 100 when spindle cap 23 is removed from spindle 20 and maintaining dispensable material 100 on spindle 20 when spindle cap 23 is replaced back onto spindle 20. As shown in FIG. 1, spindle cap 23 may be sized to allow manual gripping of spindle cap 23, enhancing the use of the present invention as a two-handed dispenser. In alternative embodiments, spindle cap 23 may be fixedly attached to or integral with spindle 20. In a further alternative embodiment, spindle cap 23 may be sized smaller than or the same size as the inner diameter of dispensable material 100.

For ease of use, in an alternate embodiment bearing 21 and bearing 22 may be slidably seated onto spindle 20 such that dispensable material 100 is in communication with and secured between bearing 21 and bearing 22 on spindle 20. Bearing 21 and bearing 22 thus allow dispensable materia 100 to more easily despool by having dispensable material 100 rotate freely about spindle 20 on bearing 21 and bearing 22. In a further alternative embodiment, bearing 21 and bearing 22 may be torqued against dispensable material 100 to better control the rate of despooling. Torque may be provided by having bearing 21 and bearing 22 threaded onto spindle 20, via spindle cap 23 compressing on bearing 21, or via locking bolts, clamps, or other locks which secure bearing 21 or bearing 22 into position on spindle 20.

Handle 30 is rotatably attached to one end of base 10. Handle 30 comprises a handle base 31 attached to base 10 via base coupler 11 which may be a pivoting hinge 28 or U-joint 29 and a handle grip 32 attached to handle base 31. Alternatively, a handle grip 32 may be integral with handle base 31. Handle grip 32 may be of any shape, including ergonomically shaped for a human hand. In one embodiment, a human hand can grip handle 30 by inserting human fingers through an aperture 301 in handle 30 and gripping handle grip 32. In a further alternative embodiment, a handle strap may be attached to handle grip 32. Handle 30 may further comprise a handle top 34 that may be integral with or attached to handle grip 32. A handle edge 33 may also be provided and may be integral with or attached to handle base 31, to handle top 34, or to both handle base 31 and handle top 34.

Handle base 31 is movably mounted to base coupler 11. Handle base 31 is substantially cylindrical and connected to base coupler 11 by a locking fastener 22 attached to base 10, thus allowing handle base 31 to move radially with respect to base 10. Alternatively, handle base 31 may be non-cylindrical. In a further alternative embodiment, referring now to FIG. 3A handle base 31 may pivot about base 10 using a hinge to connect handle base 31 to base 10. In a further alternative, handle base 31 may move both radially and pivotally using a U-joint to connect handle base 31 to base 10.

Figure 3:
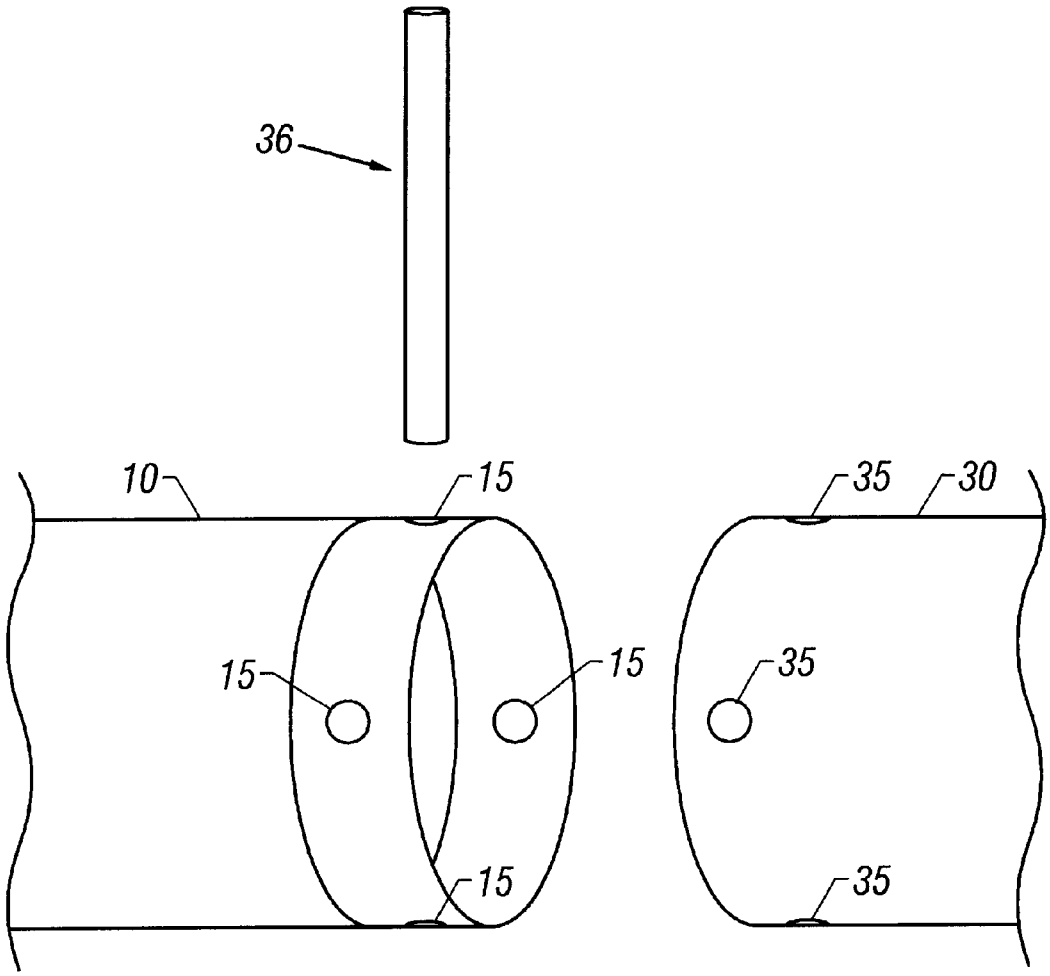
FIG. 3 is a perspective view of a locking fastener.
Figure 3A:
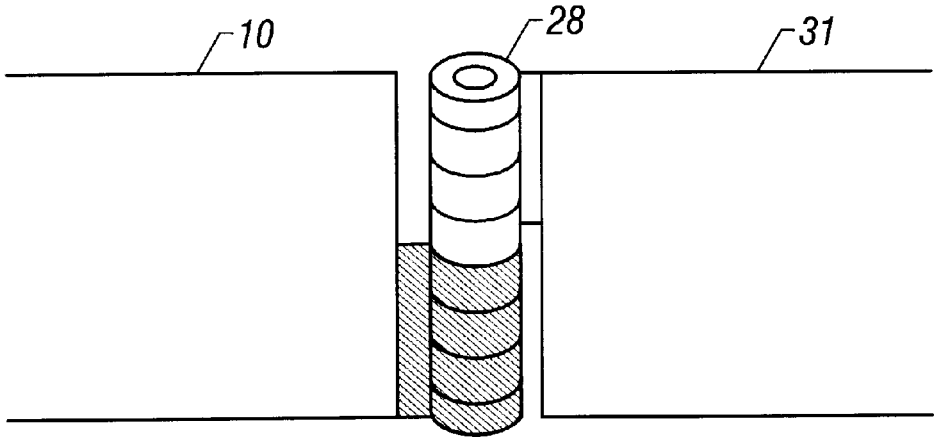
FIG. 3A is a side perspective view of a hinge providing pivotal movement of the handle base about the base.
Figure 3B:
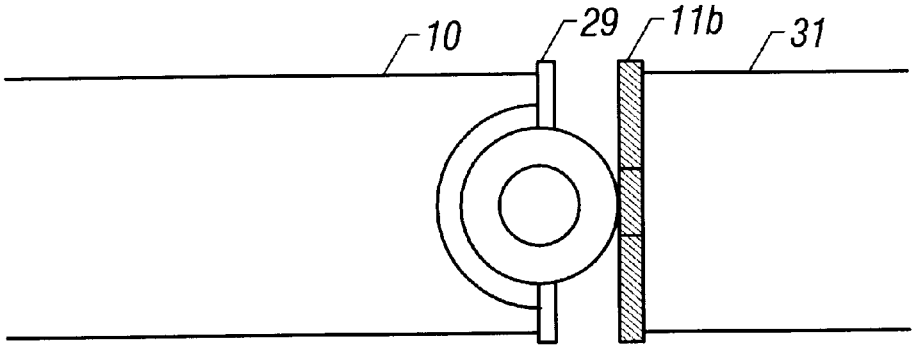
FIG. 3B is a side perspective view of a u-joint providing pivotal movement of the handle base about the base.

Locking fastener 11*b* allows free rotation of handle 30 about base 10 when locking fastener 11*b* is in an unlocked position, and secures handle 30 to base 10 when locking fastener 22 is in a locked position. As shown in FIG. 3, a perspective view of a locking fastener, locking fastener 11*b* comprises one or more fastener holes 15 in base 10, a locking pin 36, and one or more handle holes 35 in handle 30. Removing locking pin 36 allows handle 30 to move until handle holes 35 are aligned with fastener holes 15. Reinserting locking pin 36 through aligned handle holes 35 and fastener holes 15 disables handle 30 movement. Locking fastener 22 may be any form of locking assembly which allows free movement of handle 30 with respect to base 10, including compression couplings, rack and pinion, or ratchets.

Figure 4:
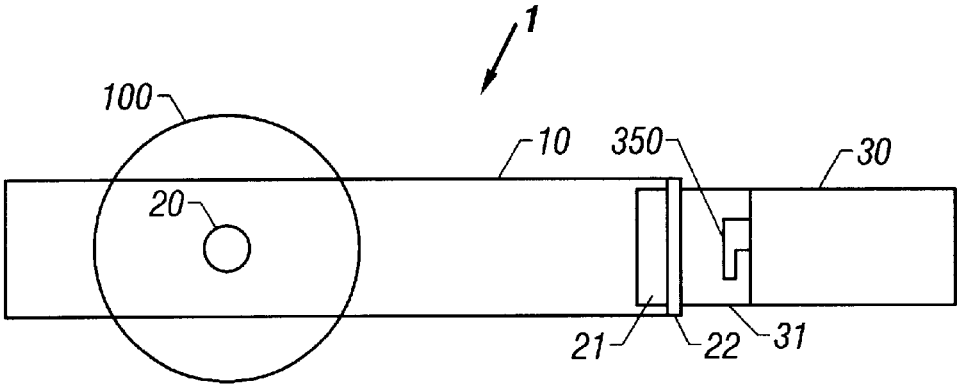
FIG. 4 is a top view of the present invention.
Figure 5:
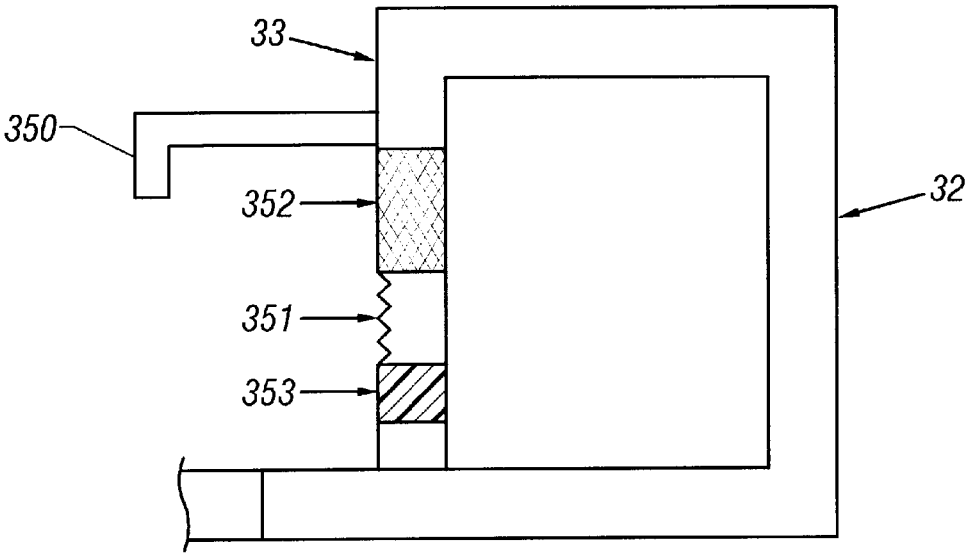
FIG. 5 is a side view of alternate wrap fasteners for the present invention.

Referring now to FIG. 4, a top view of the present invention, a material fastener 350 is fixedly attached to handle edge 33. In alternative embodiments, material fastener 350 may be fixedly attached to base 10, removably attached to either handle 30 or base 10, or fixedly or removably attached to handle grip 32 or handle base 31. Material fastener 350 is a clip, but material fastener 350 may be any fastener capable of securing a loose end of dispensable material 100. Material fastener 350 may be a serrated edged fastener 351 or a roughened or serrated surface 352 on handle 30 or handle grip 33. Alternatively, a coating 353, including rubber coating, plastic coating, chemical treatments, and the like, can be applied to handle grip 32 or handle edge 33 to produce a tackiness capable of securing a loose end of dispensable material 100.

Dispensable material 100 may be rolls of plastic wrapping film, or may be paper, string, cable, or any other material which is able to be dispensed about a spindle.

Use of the present invention in one of its embodiments is described in reference to FIG. 1. Spindle grip 23 is removed from spindle 20, and dispensable material 100 is rotatably mounted onto spindle 20. Spindle cap 23 is then replaced onto spindle 20. By changing locking fastener 11*b* to the unlocked position, handle 30 may then be rotated as needed to provide ease of use when the present invention is used to wrap items with dispensable material 100 where such items are either overhead, below, at waist level, or any other position relative to the person using the present invention. Locking fastener 11*b* is then changed to its locked position, and dispensable material 100 dispensed. When finished dispensing dispensable material 100, the free end of dispensable material 100 may then be secured by material fastener 350.

It can be seen from the preceding description that an apparatus for an improved dispenser handle has been provided.

It is noted that the embodiment of the improved dispenser handle described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An improved material dispenser, comprising:

a base having a first end and a second end;

a spindle for receiving dispensable material, said spindle having an bottom end and a top end, said bottom end being attached to said first end of said base; and a handle having a grip and a rotation end, said rotation end being movably attached to said second end of said base;

whereby said handle may be adjusted relative to said base, allowing a user to achieve a more-or-less constant planar relationship between the dispensable material and an object to be wrapped.

2. The improved material dispenser of claim 1 wherein said bottom end of said spindle is fixedly attached to said first end of said base.

3. The improved material dispenser of claim 1 wherein said bottom end of said spindle is removably attached to said first end of said base.

4. The improved material dispenser of claim 1 wherein said bottom end of said spindle is rotatably attached to said first end of said base.

5. The improved material dispenser of claim 1 further comprising a spindle cap wherein said spindle cap is attached to said top end of said spindle.

6. The improved material dispenser of claim 5 wherein said spindle cap is fixedly attached to said top end of said spindle.

7. The improved material dispenser of claim 5 wherein said spindle cap is removably attached to said top end of said spindle.

8. The improved material dispenser of claim 1 wherein said handle further comprises an aperture for accepting human fingers therethrough.

9. The improved material dispenser of claim 8 wherein said handle is U-shaped.

10. The improved material dispenser of claim 1 wherein said base further defines a plane having an axis therethrough about which said rotation end of said handle rotates in parallel.

11. The improved material dispenser of claim 1 wherein said rotation end further comprises a hinge disposed intermediate said handle and said base whereby said rotation end may pivot about said hinge and said base.

12. The improved material dispenser of claim 1 further comprising a material fastener attached to said handle wherein a loose end of said dispensable material is removably secured to said fastener.

13. The improved material dispenser of claim 12 wherein said fastener is removably attached to said handle.

14. The improved material dispenser of claim 12 wherein said fastener is a clip.

15. The improved material dispenser of claim 1 further comprising a fastener attached to said base wherein a loose end of said dispensable material is removably secured to said fastener.

16. The improved material dispenser of claim 15 wherein said fastener is removably attached to said base.

17. The improved material dispenser of claim 15 wherein said fastener is a clip.

18. The improved material dispenser of claim 1 further comprising a locking fastener, said locking fastener having at least one position whereby said locking fastener allows said handle to be moved and at least one position whereby said locking fastener secures said handle from being moved.

19. The improved material dispenser of claim 18 wherein said locking fastener further comprises a locking pin and a fastener hole, said handle has a handle hole sized to receive said locking pin, and said locking pin is removably in communication with said handle hole and said fastener hole.

20. The improved material dispenser of claim 1 further comprising a first bearing disposed about said spindle and a second bearing disposed about said spindle whereby said dispensable material is situated between and is in communication with said first bearing and said second bearing.

* * * * *